United States Patent [19]

Brown et al.

[11] Patent Number: 4,537,456

[45] Date of Patent: Aug. 27, 1985

[54] ELECTRICAL CONNECTOR

[75] Inventors: Vincent B. Brown, Prospect Heights; Charles A. Kozel, McHenry; John T. Scheitz, Palatine; John E. Armando, Schiller Park, all of Ill.

[73] Assignee: Methode Electronics Inc., Chicago, Ill.

[21] Appl. No.: 386,016

[22] Filed: Jun. 7, 1982

[51] Int. Cl.[3] ..... H01R 13/38

[52] U.S. Cl. ..... 339/99 R; 339/98

[58] Field of Search ..... 339/99 R, 97 R, 97 P, 339/98, 49 R, 96

[56] References Cited

U.S. PATENT DOCUMENTS

| | | | |
|---|---|---|---|
| 3,835,445 | 9/1974 | Hardesty | 339/105 X |
| 4,010,996 | 3/1977 | Hopkins | 339/258 R |
| 4,099,819 | 7/1978 | Keglewitsch | 339/99 R |
| 4,153,326 | 5/1979 | Frantz | 339/99 R |
| 4,195,898 | 4/1980 | Chow et al. | 339/103 R X |
| 4,226,494 | 10/1980 | Mazzeo et al. | 339/64 M X |

FOREIGN PATENT DOCUMENTS

| | | | |
|---|---|---|---|
| 1315693 | 5/1973 | United Kingdom | 339/59 M |

*Primary Examiner*—William R. Briggs

*Attorney, Agent, or Firm*—Charles F. Pigott, Jr.

[57] ABSTRACT

An electrical power connector including an insulator housing in which are mounted a plurality of conductive metal contacts each of which is provided with insulation displacement jaws for mechanically restraining and also making electrical contact with a corresponding plurality of insulated wires, each wire being terminated by forcing the same between a pair of contact jaws. The electrical connector is of a hermaphroditic design for mating with a like connector, so that each contact in one connector is electrically connected with a corresponding contact in a mating connector. The connector housing includes a hinged cover which insulates the contacts, and bosses formed on the inside of the hinged cover serve to retain the contacts and the wires terminated therein, and also serve as a tool for forcing individual insulated wires between the insulation displacement jaws of a corresponding contact.

10 Claims, 7 Drawing Figures

ELECTRICAL CONNECTOR

BRIEF SUMMARY OF THE INVENTION

It is known to provide an electrical connector including a housing containing a plurality of metal contacts each of which has at least one pair of insulation displacement jaws which receive an insulated wire therebetween for mechanically restraining the wire and making electrical contact therewith. Such an electrical connector is shown in U.S. Pat. No. 4,243,286 granted Jan. 6, 1981, which is assigned to the assignee of the present invention.

Hermaphroditic electrical connectors are also known, and such a connector is shown in copending U.S. patent application, Ser. No. 162,247, filed June 23, 1980. and also assigned to the assignee of the present invention. The hermaphroditic connector disclosed in the foregoing pending application includes insulation displacement jaws of the type disclosed in the above-mentioned U.S. Pat. No. 4,243,286.

It is a general object of the present invention to provide an improvement over the foregoing known electrical connectors, and more particularly an improved hermaphroditic power connector having an insulator housing including a hinged cover portion.

A more specific object of the invention is to provide an improved connector housing as last above-mentioned where the hinged cover portion serves to insulate the electrical contacts within the housing and has bosses formed on the inside for retaining contacts and insulated wires in place.

The foregoing and other objects and advantages of the invention will be apparent from the following description of a preferred embodiment, taken in conjunction with the accompanying drawings.

Figure 1:
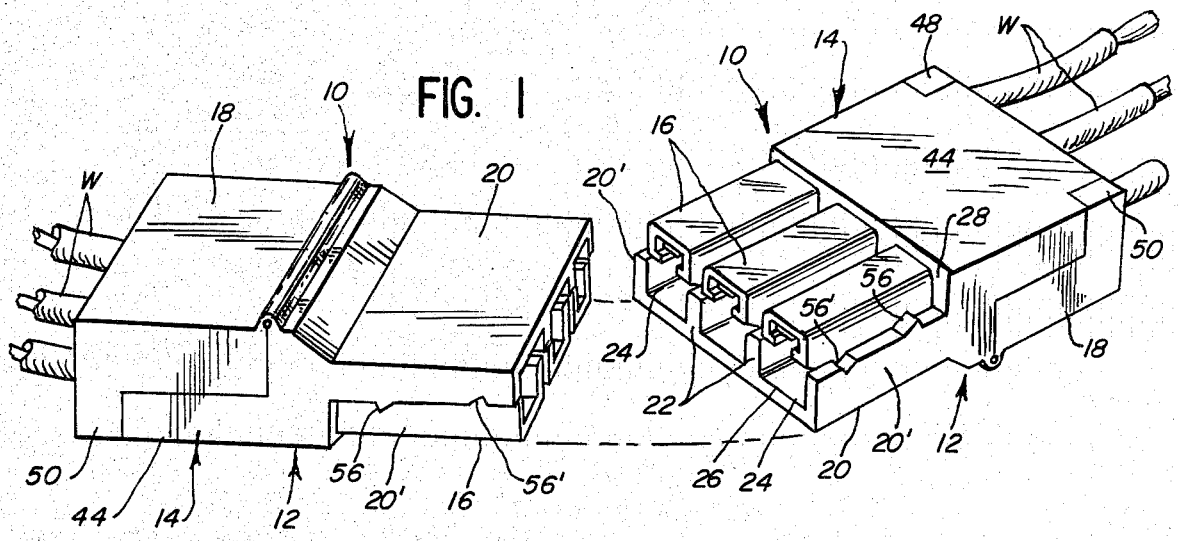
FIG. 1 is a perspective view showing a pair of hermaphroditic power connectors constructed in accordance with the present invention, each connector having three contacts and associated wires, and the connectors being shown in position for mating with one another.

Now, in order to acquaint those skilled in the art with the manner of making and using our invention, we shall describe, in conjunction with the accompanying drawings, a preferred embodiment of the invention.

DETAILED DESCRIPTION OF THE INVENTION

Referring now to the drawings, FIGS. 1–4 show a pair of power connectors 10 of identical construction and of hermaphroditic design for mating with one another. Because the two illustrated connectors are of identical design, the following description will apply to both connectors.

Each power connector 10 includes a housing 12 of plastic or other insulating material comprising a rigid housing section 14, a plurality of flexible fingers 16, and a hinged cover section 18. The rigid housing section 14 includes a wall 20 having partitions 22 to define compartments 24 for receiving metal contact members 26. Each compartment 24 is further defined opposite the rigid wall 20 by a corresponding one of the flexible fingers 16. Each flexible finger 16 has one end integral with a transverse wall 28 of the rigid housing section 14 so as to be mounted in cantilever fashion with its outer end free. Each flexible finger 16 is generally U-shaped in cross-section as shown in FIG. 1, and the width of each finger is less than the space between adjacent partitions 22 to permit such fingers to be partially received within the corresponding compartments 24 of a mating connector.

It will be understood that the power connector of the present invention may be made with different numbers of metal contacts to accommodate termination of a corresponding number of insulated wires, and the preferred embodiment shown herein is illustrated with three connector contacts by way of example only. Each contact 26 comprises a bent outer contact portion 30 (see FIGS. 3 and 4) and a base portion 32, and the base portion has two sets of insulation displacement jaws 34 and 36. Each set of jaws includes a pair of oppositely disposed jaw members between which an insulated wire to be terminated is forced, whereby the oppositely disposed jaws penetrate the insulation of a wire so as to make electrical contact with the conductive wire and also to longitudinally retain the insulated wire in the connector.

The insulation displacement jaws 34 and 36 are fully described in the above-mentioned U.S. pending patent application, Ser. No. 162,247, filed June 23, 1980, and thus such members will not be completely described herein. However, it will be understood that each jaw is generally U-shaped to provide two points of contact, and thus where two pairs of opposed jaws 34 and 36 are utilized as described herein, eight points of electrical contact are developed with a single insulated wire terminated in the connector.

Figure 3:
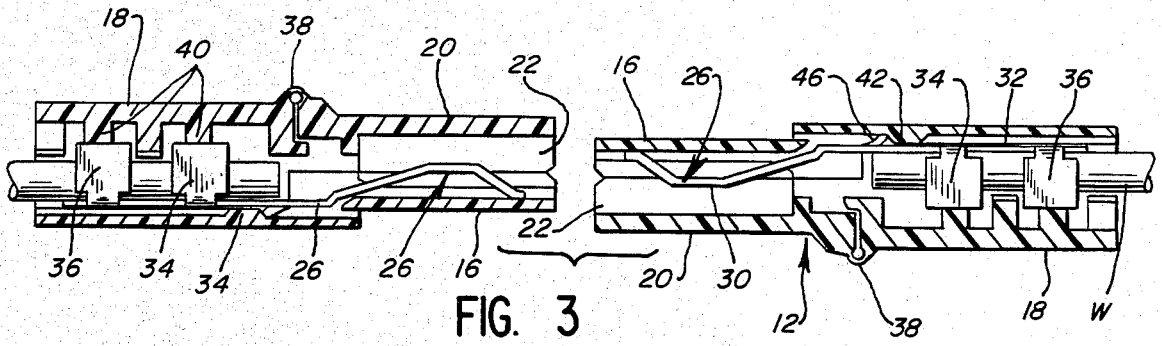
FIG. 3 is a sectional view showing the two power connectors of FIG. 1 in position for mating with one another.
Figure 4:
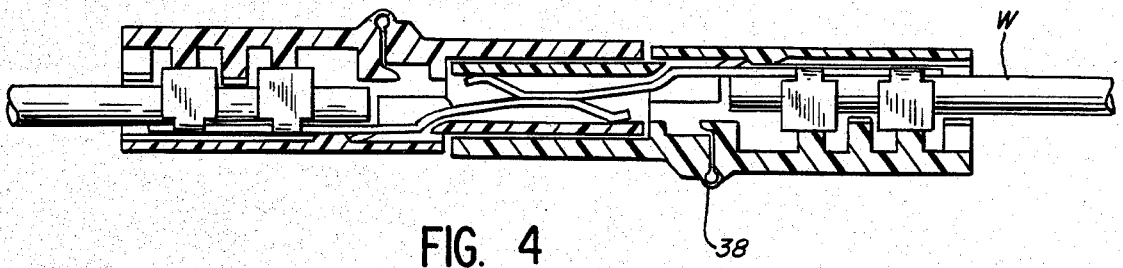
FIG. 4 is a sectional view similar to FIG. 3 showing the two connectors in mated position.
Figure 5:
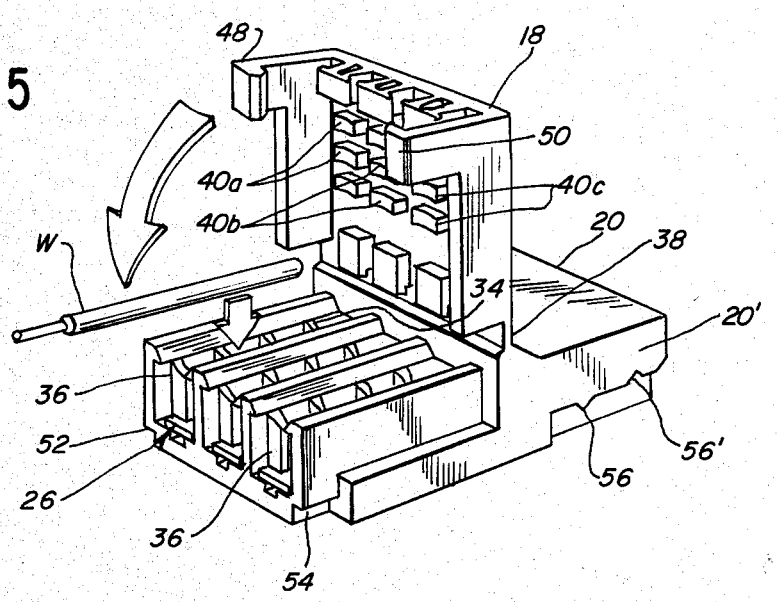
FIG. 5 is a perspective view of an electrical connector constructed in accordance with the present invention, showing a hinged cover section pivoted to its open position to expose the three metal contacts located within the connector housing, and also showing a plurality of bosses formed on the inside of the hinged cover.
Figure 6:
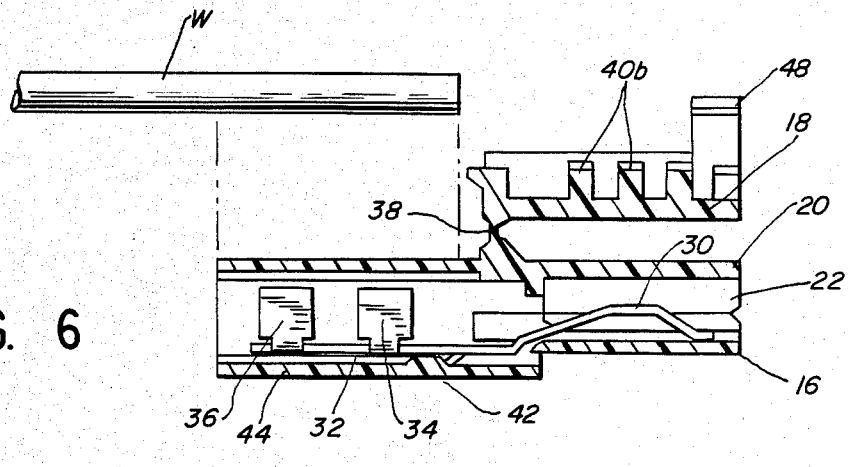
FIG. 6 is a sectional view of the power connector of FIG. 5 showing the hinged cover section pivoted to its fully open position and showing an insulated wire prior to termination to one of the contacts of the connector.

FIGS. 2–7 illustrate the manner in which the hinged cover 18 is connected to the rigid housing body portion 14 by a thin hinge 38 which is integral with the hinged cover and with the rigid body portion 14. FIGS. 1–4 and 7 show the hinged cover 18 in its closed position, while FIG. 5 shows the cover partly open, and FIG. 6 shows the cover in its maximum open position. As shown in FIGS. 5 and 6, a plurality of bosses 40 are formed on the inside of the cover 18 for cooperation with the contacts 26 and also with insulated wires W terminated in the connector. As best shown in FIGS. 5 and 6, there are three rows of aligned bosses 40*a*, 40*b* and 40*c*, there being one row of bosses for each of the contacts 26 with each row being aligned with a corresponding one of the contacts 26 and associated insulated wire W terminated therein.

The rows of bosses 40 formed on the inside of the hinged cover 18 serve several useful functions. One function is that the hinged cover 18 may be used as a tool for termination of a plurality of insulated wires W in the connector. FIG. 5 shows the end of a wire W to be terminated in the base portion 32 of a contact 26 by forcing the same downward in the direction of the arrow until it is pressed between the two pairs of jaws 34 and 36, whereby the wire is longitudinally restrained and electrical contact is made with the contact 26 at eight different points as described above.

In order to effect such termination, the wire W is lowered into position so it rests on the tops of the jaws 34 and 36, and then by simply closing the hinged cover 18, the bosses 40 will engage the wire W and force it down between the two sets of jaws to effect termination. It should be understood that normally a plurality of wires W are terminated in a single operation, and the termination of a single wire W has been illustrated by way of example only. It should further be understood that depending upon the size of the wires W and the number of wires to be terminated, it may be preferred in certain instances to utilize a separate termination tool rather than cover 18.

Figure 7:
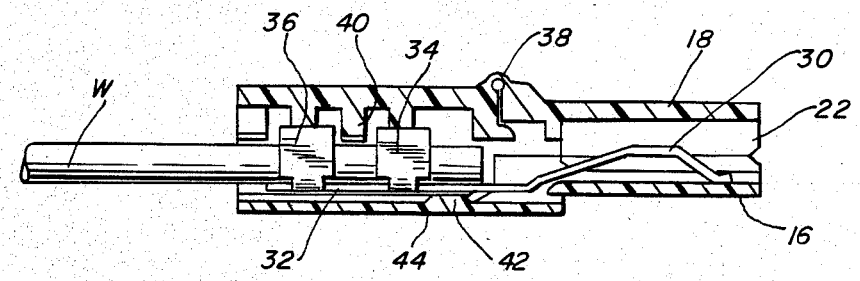
FIG. 7 is a sectional view similar to FIG. 6 showing the hinged cover section in fully closed position after having been utilized as a tool for terminating an insulated wire by pressing the same downwardly between the jaws of one of the connector contacts.

FIG. 7 illustrates the hinged cover 18 in its fully closed position after termination of three wires W in three contacts 26 contained in the housing. It will be seen that the concave ends of the bosses 40 are closely adjacent the top of the insulated wire W. Therefore, in addition to enabling the cover 18 to be utilized as a termination tool, the bosses 40 serve the function of affording transverse axial strain relief for the insulated wires W. In other words, the bosses 40 restrain the insulated conductors W against withdrawal from the contact jaws 34 and 36 in a transverse direction. As explained previously, longitudinal retention of the insulated wires W is afforded by the jaws 34 and 36 themselves after they have penetrated the wire insulation during termination.

Another function of the bosses 40 formed on the hinged cover 18 is that they assist in restraining the contacts 26 within the housing. When the hinged cover 18 is in its closed position as shown in FIG. 7, the bosses 40 in each of the aligned rows project in between the various opposed jaws of the sets of U-shaped jaws 34 and 36 thereby blocking longitudinal movement of such jaws. Therefore, upon longitudinal pulling of an insulated wire W which has been terminated in a contact 26, the longitudinal force on the associated contact will be resisted by the projecting bosses 40 which are in interfering relation with the jaws 34 and 36.

It will further be noted as shown in FIGS. 3 and 4 that additional longitudinal retention means is provided in the form of internally molded bosses 42, one for each contact 26, molded on the inside of a wall portion 44 of the rigid housing section 14, which boss 42 cooperates with a metal barb 46 formed on the contact 26, thereby affording additional longitudinal retention for the contact.

A further advantage of the hinged cover 18 is that it provides a safety feature by fully insulating the contacts 26 when the cover is closed. When the connector is in use, cover 18 will normally be fully closed as shown in FIGS. 1–4. FIG. 5 illustrates a pair of latching arms 48 and 50 having inwardly projecting latching portions which engage under shoulders 52 and 54 when the cover is fully closed. In such closed position, no portion of the metal contacts 26 is exposed, and thus the cover 18 provides a useful insulating function without interfering with termination of insulated conductors W when the cover is in its open position.

Figure 2:
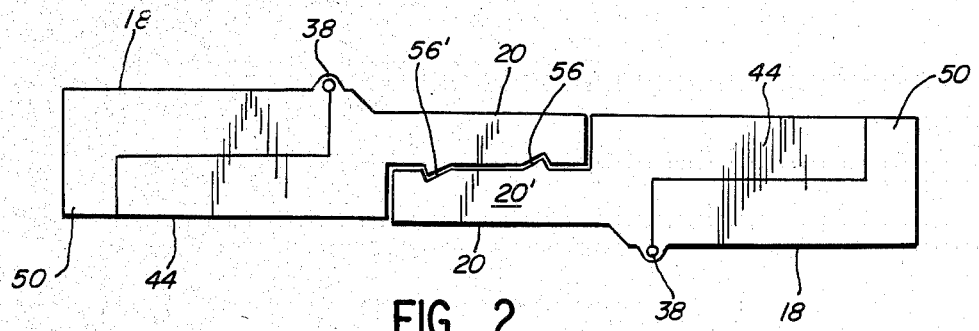
FIG. 2 is a side elevational view showing the two connectors of FIG. 1 in mated position.

FIGS. 1 and 2 illustrate that side wall portions 20′ formed on opposite sides of the rigid housing wall 20 have bosses 56 and recesses 56′ formed thereon for interlocking with a like connector. As shown in the right-hand portion of FIG. 1, the side wall 20′ is formed with a boss 56 having one surface inclined at 30 degrees to the plane of the connector and a second surface inclined at 60 degrees. Spaced outwardly therefrom, the same wall 20′ is formed with a similarly shaped recess 56′ having a 60 degree surface and a 30 degree surface.

Each of the two sidewalls 20′ of each connector 10 is provided with one boss 56 and one similarly shaped recess 56′, and such bosses and recesses are hermaphroditic to permit cooperation with like bosses and recesses on an identical mating connector 10 as shown in FIG. 2. It should further be understood that when two such connectors are forced together in mated relation as shown in FIG. 2, the active engaging surfaces are the 30 degree surfaces on the bosses 56. On the other hand, when separating two mated connectors, the active engaging surfaces are the 60 degree surfaces. Thus, such bosses make it more difficult to separate two connectors than to connect them together.

Referring again to FIGS. 3 and 4, it will be seen that when two of the hermaphroditic connectors 10 are interconnected, the flexible plastic fingers 16 and adjacent contacts 26 of one connector enter into corresponding compartments 24 defined in the other connector by the partitions 22. As a result, the contact 26 of the left-hand connector in FIG. 3 enters beneath the contact 26 of the right-hand connector causing the left-hand contact to be deflected downwardly and the right-hand contact to be deflected upwardly.

In addition, during the above-described mating of two connectors, the respective flexible plastic fingers 16 are flexed in the same direction as the contacts. Thus, the flexible fingers 16 of the left-hand connector in FIG. 3 are deflected downwardly, while the fingers 16 of the right-hand connector are deflected upwardly. The walls 20 of the connectors opposite the fingers 16 are rigid as previously described. Further, each of the contacts 26 is pre-loaded so that even before mating with the contact of another connector, the contact is pressed against the inside wall of an adjacent flexible finger 16 as shown in FIG. 3.

What is claimed is:

1. An electrical connector of the type having an unsulator housing and a plurality of conductive contacts within the housing for terminating corresponding insulated conductors, each contact having at least one pair of insulation displacement jaws which receive an insulated conductor therebetween and sever the insulation to make electrical contact with the conductor, the improvement comprising, in combination, an insulator housing including a top and a base, said base having a plurality of parallel compartments for mounting individual metal contacts, a metal contact positioned in each of said parallel compartments with a forward mating contact portion extending toward a forward end of said base and a rearward contact portion disposed in a rear portion of said base, said rearward contact portion having at least one pair of insulation displacement jaws for terminating an insulated conductor, said top including a rigid forward top wall and a hinged rear top wall which is hingedly connected at the rear of said rigid forward top wall, bottom wall means for cooperating with said forward top wall and hinged rear top wall in the closed position for enclosing said metal contacts, a plurality of bosses formed on the bottom of said hinged rear top wall with at least one boss aligned with each of said parallel compartments and projecting sufficiently so when said cover is in a closed position it functions as a termination tool, said hinged rear top wall being movable between an open position where it folds back over the top of said rigid forward top wall to expose said insulation displacement jaws and permits a conductor to be positioned in each of said compartments adjacent a corresponding pair of said jaws, and a closed position where said bosses terminate said conductors and said hinged rear top wall insulates said rearward contact portions, where at least one boss aligned with each of said compartments is dimensioned and located so when said cover is closed the boss forces a conductor positioned in that compartment into electrically contacting relation with said contact in said compartment and also said boss projects into interfering relation with the contact located in said compartment thereby serving to longitudinally retain said contact in said compartment when a pulling force is applied to an insulated conductor terminated therein, said electrical connector being capable of connection with an inverted connector of identical design.

2. An electrical connector as defined in claim 1 where said rigid forward top wall and said hinged rear top wall are approximately equal in size, and where said hinged rear top wall when in its closed position is approximately parallel to said rigid forward top wall.

3. An electrical connector as defined in claim 1 where said rigid forward top wall has a pair of depending side walls on which are formed hermaphroditic male and female detent means for engagement with like means on a connector mated therewith.

4. An electrical connector as defined in claim 1 where said bottom wall means includes a plurality of laterally spaced coplanar flexible fingers, one aligned with each of said contacts at said forward mating contact portion, said forward mating contact portion being preloaded against said flexible finger, and both said forward mating contact portion and said finger being conjointly deflected in the same direction when said connector is mated with a like connector.

5. An electrical connector as defined in claim 1 including a flexible integral hinge between the rear end of said rigid forward top wall and said hinged rear top wall, said integral hinge extending across substantially the full width of said rigid forward top wall and said rear top wall.

6. An electrical connector of the type having an insulator housing and a plurality of conductive contacts within the housing for terminating corresponding insulated conductors, each contact having at least one pair of insulation displacement jaws which receive an insulated conductor therebetween and sever the insulation to make electrical contact with the conductor, the improvement comprising, in combination, an insulator housing including a top and a base, said base having a plurality of parallel compartments for mounting individual metal contacts, a metal contact positioned in each of said parallel compartments with a forward mating contact portion extending toward a forward end of said base and a rearward contact portion disposed in a rear portion of said base, said rearward contact portion having at least one pair of insulation displacement jaws for terminating an insulated conductor, said top including a rigid forward top wall and a hinged rear top wall which is hingedly connected at the rear of said rigid forward top wall, a plurality of bosses formed on the bottom of said hinged rear top wall with at least one boss aligned with each of said parallel compartments and projecting sufficiently so when said cover is in a closed position it functions as a termination tool, said hinged rear top wall being movable between an open position where it folds back over the top of said rigid forward top wall to expose said insulation displacement jaws and permits a conductor to be positioned in each of said compartments adjacent a corresponding pair of said jaws, and a closed position where said bosses terminate said conductors and said hinged rear top wall insulates said rearward contact portions, and bottom wall means cooperating with said forward top wall and hinged rear top wall in the closed position to enclose said individual metal contacts, said bottom wall means including a plurality of laterally spaced, coplanar flexible fingers, one aligned with each of said contacts at said forward mating contact portion, said forward mating contact portion being preloaded against said flexible fingers, and both said forward mating contact portion and said fingers being conjointly deflected in the same direction when said connector is mated with a like connector, with the flexible fingers of two identical joined connectors being positioned outside of mating metal contacts of the joined connectors, and in turn said flexible fingers are positioned inside respective forward top walls of the joined connectors.

7. An electrical connector as defined in claim 6 including a flexible integral hinge between the rear end of said rigid forward top wall and said hinged rear top wall, said integral hinge extending across substantially the full width of said rigid forward top wall and said rear top wall to facilitate the action of forcing conductors positioned therein into electrically contacted relation with said insulation displacement jaws of said connector.

8. An electrical conductor as defined in claim 7 where said rigid forward top wall has a pair of depending sidewalls on which are formed hermaphroditic male and female detent means for engagement with like means on a connector mated therewith.

9. An electrical connector as defined in claim 8 where at least one boss aligned with each of said compartments is dimensioned and located so when said cover is closed the boss projects into interfering relation with the contact located in said compartment thereby serving to longitudinally retain said contact in said compartment when a pulling force is applied to an insulated conductor terminated therein.

10. An electrical connector as defined in claim 9 where said rigid forward top wall and said hinged rear top wall are approximately equal in size, and where said hinged rear top wall when in its closed position is approximately parallel to said rigid forward top wall.

* * * * *